United States Patent [19]

Wilks

[11] Patent Number: 4,457,789

[45] Date of Patent: Jul. 3, 1984

[54] PROCESS FOR ANNEALING STEELS

[75] Inventor: Gerald W. Wilks, Calumet City, Ill.

[73] Assignee: LaSalle Steel Company, Hammond, Ind.

[21] Appl. No.: 298,384

[22] Filed: Sep. 1, 1981

Related U.S. Application Data

[63] Continuation of Ser. No. 093,007, Nov. 9, 1979, abandoned.

[51] Int. Cl.[3] ..... C21D 6/00

[52] U.S. Cl. ..... 148/134; 148/36; 148/154

[58] Field of Search ..... 148/134, 154, 36

[56] References Cited

U.S. PATENT DOCUMENTS 3,855,013 12/1974 Prohaszka et al. ..... 148/154

*Primary Examiner*—R. Dean

*Attorney, Agent, or Firm*—Fitch, Even, Tabin & Flannery

[57] ABSTRACT

A process for the annealing of hypoeutectoid steels wherein a steel is rapidly heated to a temperature above the upper transformation temperature of the steel to convert the steel to austenite and carbides, followed by cooling of the steel. The rate of heating of the steel is such as to cause dissolution of most of the carbides in the austenite thus formed, thereby leaving small particles of undissolved carbide in an amount sufficient to serve as nuclei for the precipitation of upper transformation products on cooling. Steels processed in accordance with the process of this invention are characterized by improved ductility and toughness as well as good machinability characteristics.

10 Claims, 31 Drawing Figures

AS RECEIVED 4142
SEM 5000X PICRAL
HEAT A

4142, HEATED TO
1415°F AND QUENCHED
SEM 5000X PICRAL
HEAT A

4142 HEATED TO
1415°F AND AIR COOLED
SEM 5000X PICRAL
HEAT A

AS RECEIVED 4140
SEM 2000X PICRAL
HEAT C

FURNACE ANNEALED 4140
SEM 2000X PICRAL
HEAT C

4140 ANNEALED BY
THE NEW PROCESS
SEM 2000X PICRAL
HEAT C

AS RECEIVED 4140
SEM 2000X PICRAL
HEAT D

FURNACE ANNEALED 4140
SEM 2000X PICRAL
HEAT D

4140, ANNEALED BY
THE NEW PROCESS
SEM 2000X PICRAL
HEAT D

AS RECEIVED 8640
SEM 2000X PICRAL
HEAT B

FURNACE ANNEALED 8640
SEM 2000X PICRAL
HEAT B

8640 ANNEALED BY
THE NEW PROCESS
SEM 2000X PICRAL
HEAT B

AS RECEIVED 6150
SEM 2000X PICRAL
HEAT G

FURNACE ANNEALED 6150
SEM 2000X PICRAL
HEAT G

6150 ANNEALED BY
THE NEW PROCESS
SEM 2000X PICRAL
HEAT G

AS RECEIVED 1144
LIGHT METALLOGRAPH
500X PICRAL
HEAT H

FURNACE ANNEALED 1144
LIGHT METALLOGRAPH
500X PICRAL
HEAT H

1144 ANNEALED BY
THE NEW PROCESS
LIGHT METALLOGRAPH
500X PICRAL
HEAT H

AS RECEIVED 86L20
LIGHT METALLOGRAPH
500X PICRAL
HEAT I

FURNACE ANNEALED 86L20
LIGHT METALLOGRAPH
500X PICRAL
HEAT I

86L20 ANNEALED BY
THE NEW PROCESS
LIGHT METALLOGRAPH
500X PICRAL
HEAT I

PROCESS FOR ANNEALING STEELS

This is a continuation, of application Ser. No. 93,007, filed Nov. 9, 1979, abandoned.

This invention relates to the annealing of steels, and more particularly to a process for the annealing of steels to improve the forming and machining characteristics of the steel.

Annealing is a well-known process in the treatment of steels, and is used primarily to soften the steel so that it can be machined or formed into a part having the desired configuration in an economical manner. In general, annealing is carried out by heating the steel in a furnace maintained at the austenitizing temperature, from which the steel is removed and cooled in a controlled manner. The steel is heated to a temperature above the austenitizing temperature (i.e., the $A_3$ temperature) and then cooled so that the microstructure of the steel contains the so-called upper transformation products, namely pearlite, blocky ferrite, spheroidal carbides and combinations thereof. The upper transformation products are to be distinguished from the equally well-known lower transformation products, namely bainite, acicular ferrite and martensite, in that the upper transformation products are softer and more ductile than the lower transformation products. Thus, for annealing to improve machinability, the goal in the annealing process is to form upper transformation products to the substantial exclusion of lower transformation products.

Annealing is frequently carried out with respect to hot rolled steel, using large annealing furnaces. Just the size of the furnaces required in terms of space requirements and capital investment represents a significant drawback to their use. As is well known to those skilled in the art, there are several further disadvantages associated with the use of such annealing furnaces. In the first place, furnace heating efficiency is generally quite low, with the result that increasing fuel costs make it desirable to provide a more efficient means of heating the steel. In addition, furnace heating takes place by radiation, conduction and by convection as the mechanism for heat transfer, thus necessitating long cycles to insure that a load of steel in the furnace has been subjected to uniform processing in a given heating cycle. Such long cycles are themselves disadvantageous, for the elevated temperatures used require the use of a known nonoxidizing atmosphere (i.e., a protective atmosphere or vacuum), which requires additional energy to produce.

It is thus desirable to avoid the use of such large annealing furnaces provided that the physical properties of the annealed steel fall within acceptable limits. It has been proposed, as described in U.S. Pat. Nos. 3,908,431, 4,040,872 and 4,088,511 to treat steels using various thermal cycles by use of electrical resistance heating techniques. Those techniques have the advantage of providing very rapid heating of steel workpieces with high efficiencies, including uniform heating over the entire cross section of the steel workpiece.

It has now been found that annealing of steels can be significantly modified to provide steels having improved ductility and toughness when the heating to a temperature above the austenitizing temperature is rapidly carried out at a rate such that most of the carbides dissolve in the austenite thus formed, while leaving small particles of carbide in undissolved form. The small carbide particles which remain are of sufficient quantity to serve as nuclei for the growth of upper transformation products during cooling, thereby resulting in an overall acceleration of the annealing process.

It is accordingly an object of the present invention to provide an improved process for the annealing of steels.

It is a more specific object of the present invention to provide an improved process for the annealing of steels in which a steel is rapidly heated to a temperature above the $A_3$ temperature such that small particles of carbide remain in an undissolved state to serve as nuclei for growth of upper transformation products to provide an annealed steel having high levels of ductility and toughness.

It is yet another object of this invention to provide improved steels which have been annealed to yield high ductility, formability and toughness characteristics.

Figure 12A:
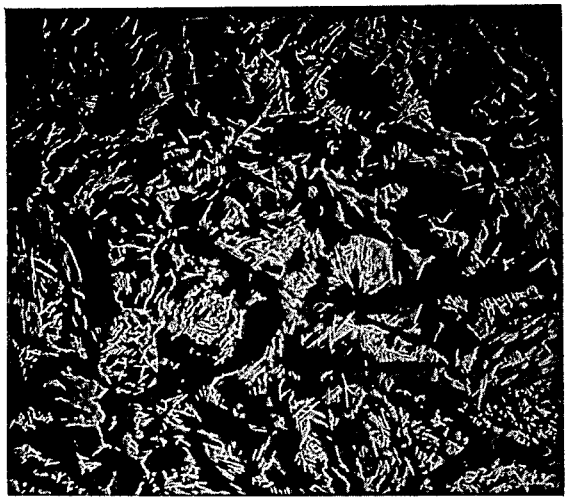
Figure 12B:
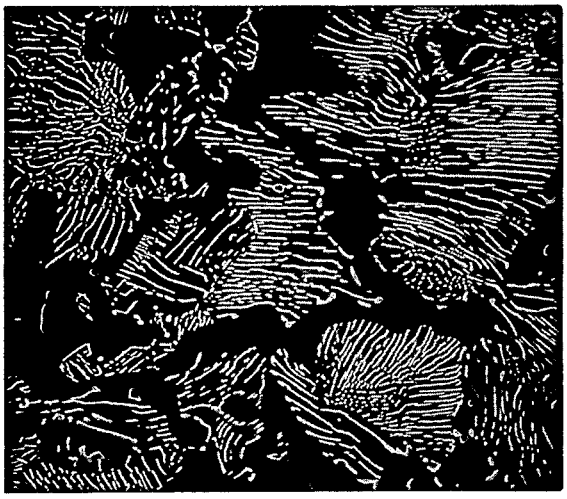
Figure 12C:
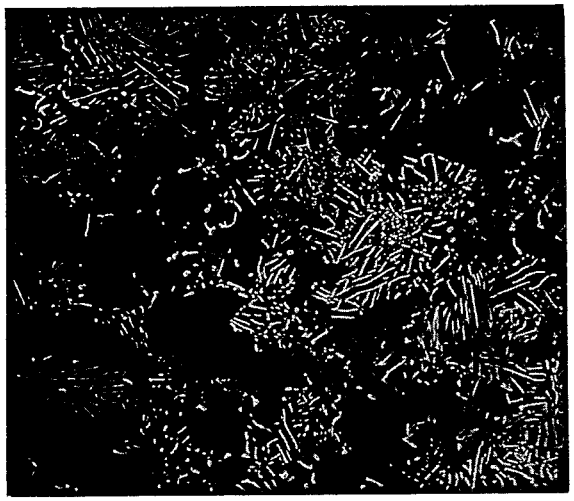
Figure 13:
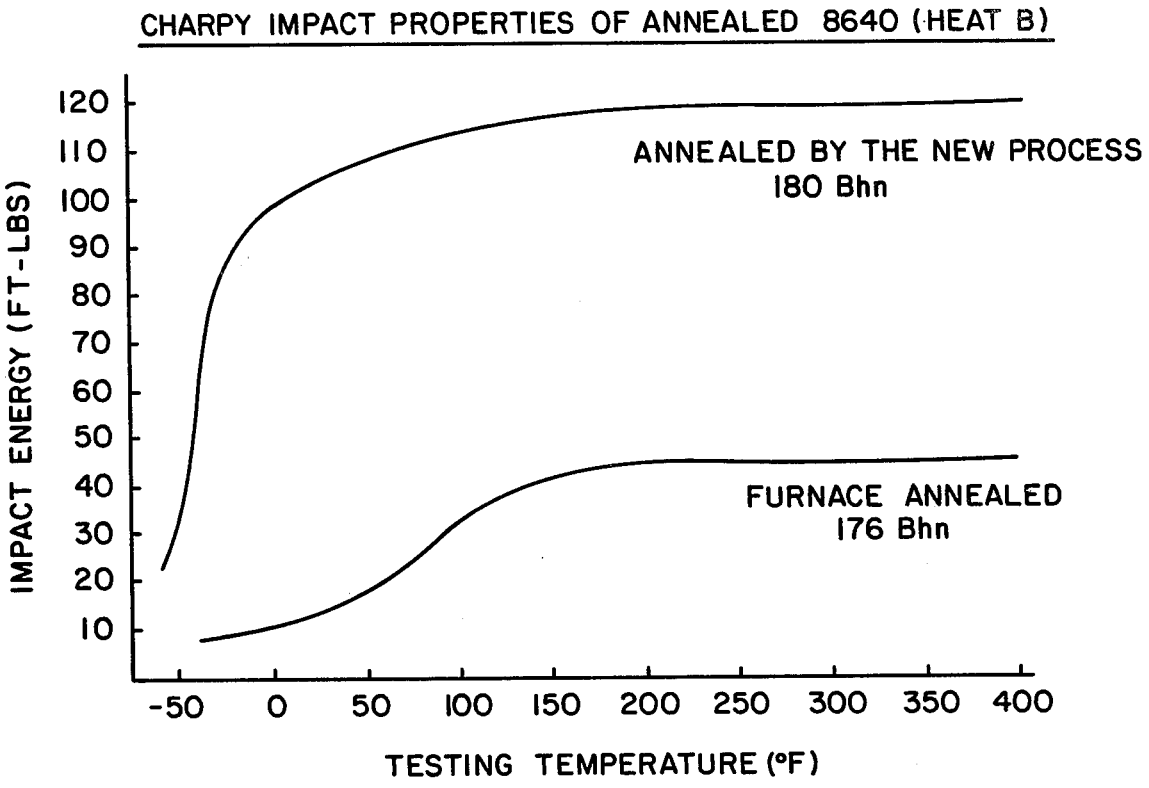
Figure 15:
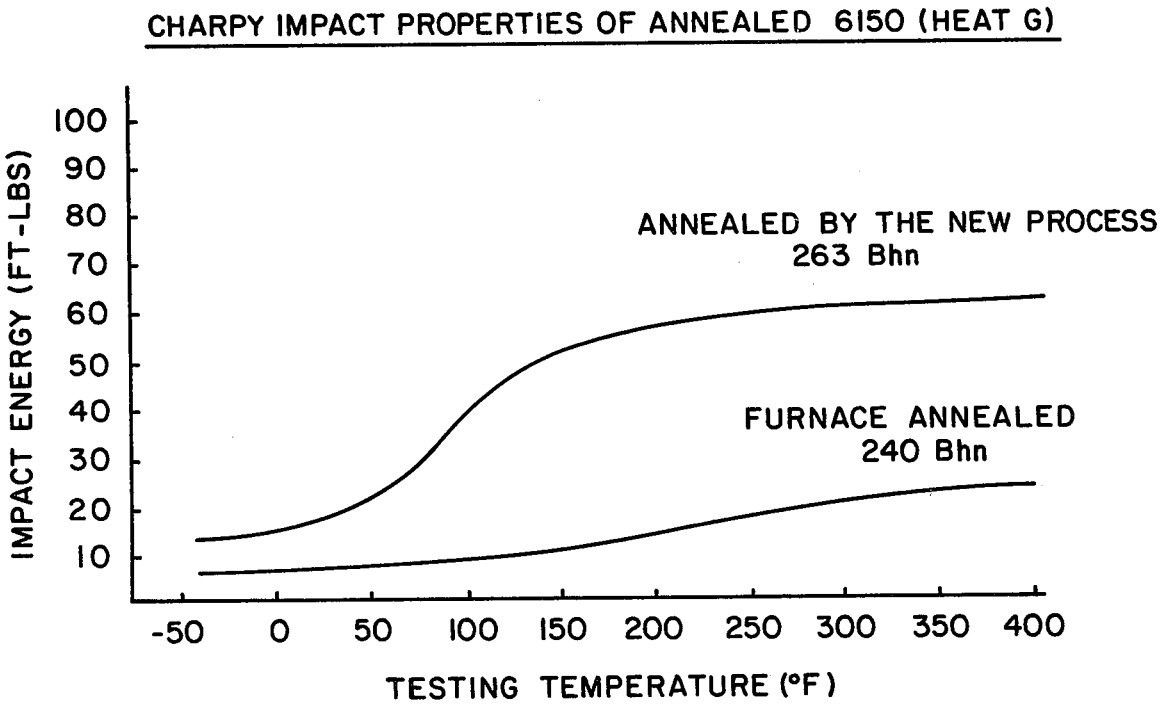
Figure 14A:
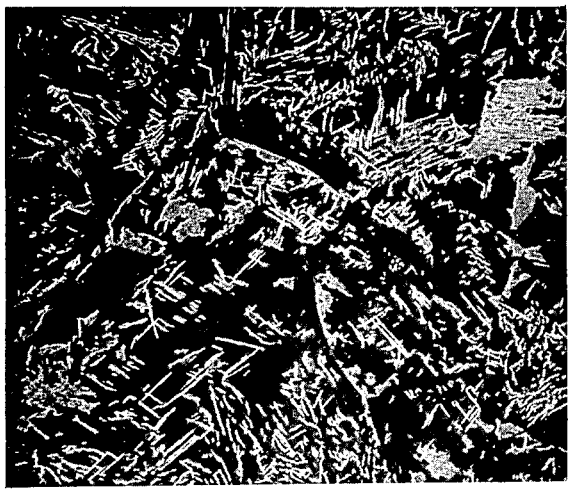
Figure 14B:
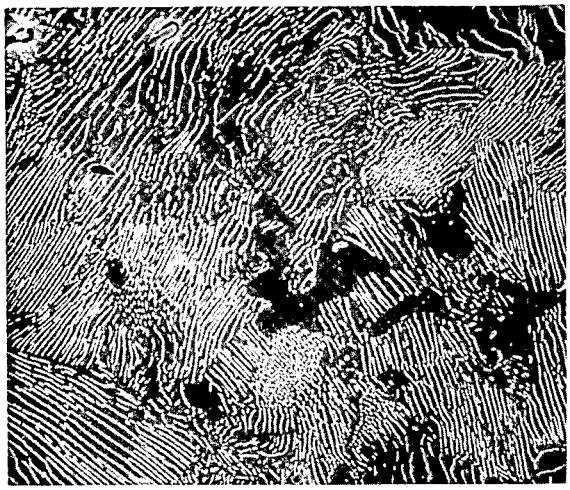
Figure 14C:
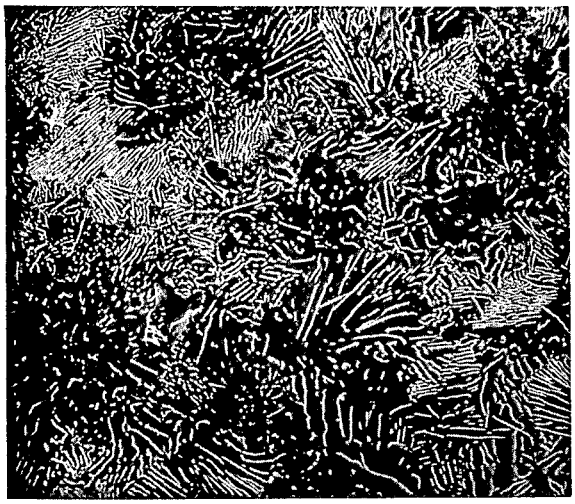
Figure 16A:
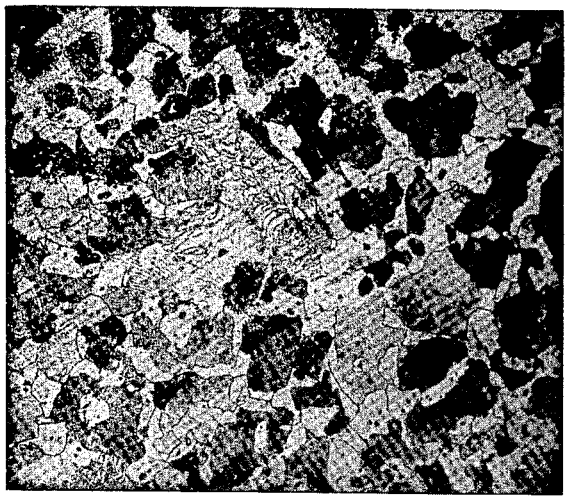
Figure 16B:
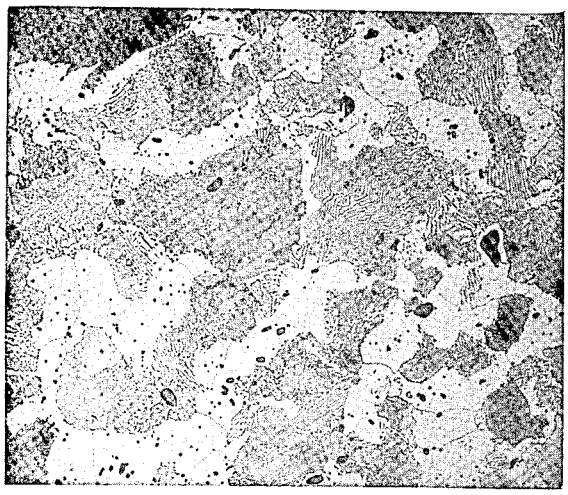
Figure 16C:
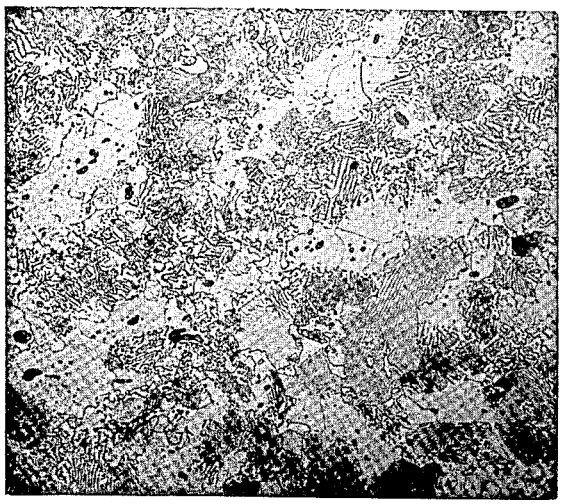
Figure 17A:
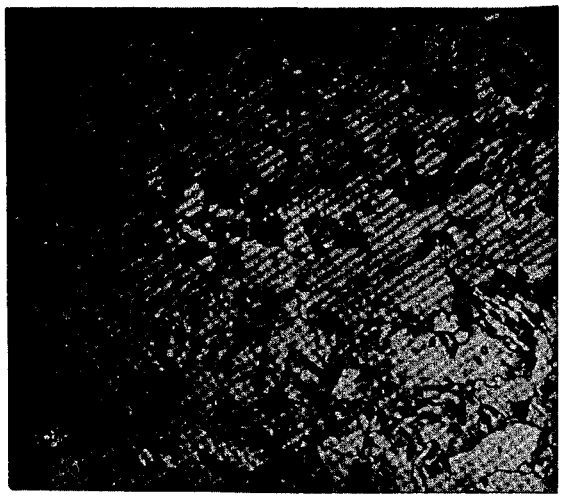
Figure 17B:
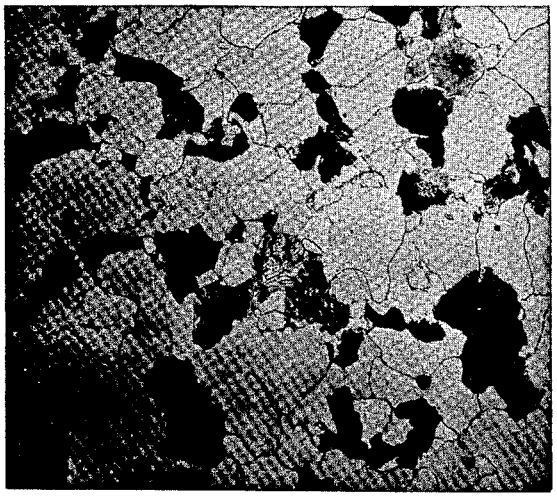
Figure 17C:
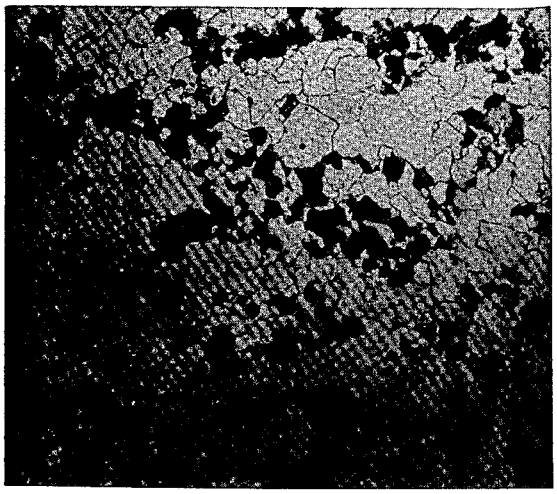

FIG. 12A is a photomicrograph showing the microstructure of 8640 steel prior to processing in accordance with the present invention (Heat B);

FIG. 12B is a photomicrograph showing the microstructure of 8640 steel which has been furnace annealed (Heat B);

FIG. 12C is a photomicrograph showing the microstructure of 8640 steel which has been annealed in accordance with the process of this invention (Heat B);

FIG. 13 is a graph of Charpy impact energy versus temperature for 8640 steel which has been furnace annealed and annealed by the process of this invention (Heat B);

FIG. 14A is a photomicrograph showing the microstructure of 6150 steel prior to treatment in accordance with the process of this invention (Heat G);

FIG. 14B is a photomicrograph showing the microstructure of 6150 steel which has been furnace annealed (Heat G);

FIG. 14C is a photomicrograph showing the microstructure of 6150 steel which has been annealed by the process of this invention (Heat G);

FIG. 15 is a graph of Charpy impact energy versus testing temperature for 6150 steel which has been annealed in a furnace and 6150 steel which has been annealed in accordance with the process of this invention (Heat G);

FIG. 16A is a photomicrograph showing the microstructure of a 1144 steel prior to processing in accordance with the process of this invention (Heat H);

FIG. 16B is a photomicrograph showing the microstructure of the 1144 steel shown in FIG. 16A after annealing in a furnace (Heat H);

FIG. 16C is a photomicrograph showing the microstructure of the 1144 steel after it has been annealed in accordance with the process of this invention (Heat H);

FIG. 17A is a photomicrograph showing the microstructure of an 86L20 steel prior to processing (Heat I);

FIG. 17B is a photomicrograph showing the microstructure of the 86L20 steel of FIG. 17A after it has been furnace annealed (Heat I); and, FIG. 17C is a photomicrograph showing the microstructure of the 86L20 steel of FIG. 17A after it has been annealed in accordance with the process of this invention (Heat I).

The concepts of the present invention reside in the discovery that high levels of ductility and toughness can be achieved with hypoeutectoid steels by annealing where the steel is rapidly heated to a temperature above the upper transformation temperature to form austenite and retained iron carbides, with the rate of heating being sufficiently rapid such that most of the carbides are dissolved in the austenite leaving small particles, usually spheroidal in form, of carbide in an undissolved state. Following that heating, the steel is cooled at a rate such that the small particles of retained carbide which are undissolved in the austenite serve as nuclei for the growth of upper transformation products, notably including pearlite and blocky ferrite as well as fine spheroids of iron carbide. It has been found that carbides thus formed on cooling are characterized by particle sizes which are much finer than those formed during furnace annealing, with the result that the refined microstructure of the annealed steel provides improved ductility, formability and toughness when compared to steel subjected to furnace annealing.

The concepts of the present invention are applicable to the processing of hypoeutectoid steels having a carbon content ranging up to 0.7% by weight, and preferably containing between 0.1 to 0.7% carbon by weight. Such steels may contain relatively small quantities of the common alloying elements such as chromium, molybdenum, nickel and manganese. By a widely used convention, a steel containing less than 5% by weight of such alloying elements is referred to in the art as a "low alloy steel." Representative hypoeutectoid steels which can be used in accordance with the present invention are shown in the following table:

TABLE 1

| Heat | Grade | Bar Diameter | C | Mn | P | S | Si | Ni | Cr | Mo | Al | Other |
|---|---|---|---|---|---|---|---|---|---|---|---|---|
| A | 4142 | 1.063 | 0.41 | 0.93 | 0.01 | 0.04 | 0.27 | 0.17 | 0.98 | 0.15 | 0.03 | |
| B | 8640 | 1.062 | 0.41 | 1.03 | 0.01 | 0.04 | 0.28 | 0.46 | 0.59 | 0.18 | 0.04 | |
| C | 4140 | 1.062 | 0.41 | 0.92 | 0.01 | 0.02 | 0.26 | 0.18 | 0.98 | 0.20 | 0.04 | |
| D | 4140 | 1.125 | 0.42 | 0.96 | 0.01 | 0.02 | 0.29 | 0.20 | 1.09 | 0.18 | 0.03 | |
| E | 4140 | 1.062 | 0.43 | 0.82 | 0.01 | 0.01 | 0.27 | 0.01 | 0.98 | 0.20 | 0.04 | |
| F | 4142 | 1.000 | 0.44 | 0.78 | 0.01 | 0.01 | 0.32 | 0.04 | 0.94 | 0.17 | 0.05 | |
| G | 6150 | 1.062 | 0.50 | 0.80 | 0.01 | 0.02 | 0.28 | 0.17 | 0.93 | 0.06 | 0.01 | V-0.12 |
| H | 1144 | 1.062 | 0.44 | 1.37 | 0.01 | 0.25 | 0.15 | — | 0.09 | 0.02 | — | |
| I | 86L20 | 1.375 | 0.20 | 0.86 | 0.01 | 0.03 | 0.25 | 0.43 | 0.53 | 0.15 | 0.03 | Pb-0.16 |

In the preferred practice of this invention, the steel is in the form of a workpiece which can be heated separately so that the heating process can be precisely controlled. For that purpose, it is frequently preferred to employ workpieces in a form having a repeating cross section such as bars, rods, tubes and the like.

In accordance with the preferred embodiment, the individual workpieces are rapidly heated by direct electrical resistance heating or by electrical induction heating, preferably while the temperature of the workpiece is monitored by a suitable sensing device. The rapidity of the heating process, while permitting the economic processing of large quantities of workpieces, causes the austenitizing transformation to proceed very rapidly. The most preferred method for rapid heating in accordance with the present invention is by direct electrical resistance heating. That technique, described in detail by Jones et al. in U.S. Pat. No. 3,908,431 (the disclosure of which is incorporated herein by reference) involves a procedure whereby an electrical current is passed through the steel workpiece; the electrical resistance of the workpiece to the flow of electrical current causes rapid heating of the workpiece uniformly throughout its entire cross section.

In heating according to the technique of Jones et al., the workpiece is connected to a source of electrical current, with the connection being made at both ends of the workpiece so that the current flows completely through the workpiece. Because of the uniform flow of the current through the workpiece, the temperature of the workpiece, usually in the form of a bar or rod, increases uniformly, both axially and radially. Thus, the interior as well as the exterior of the workpiece are heated simultaneously, without introducing thermal strains. In contrast, in a conventional furnace, the exterior of the furnace load is heated much more rapidly than the interior, with the result that the steel near the exterior of the load is completely transformed to austenite while the interior of the load may not have, at the same point in time, undergone transformation to austenite. Such furnace techniques thus involve a significant disadvantage since it is difficult, if not impossible, to control the rate of heating such that austenitic transformation along with dissolution of only part of the carbide is achieved. In other words, there is a tendency, when heating in a furnace, to dissolve all of the carbide, and hence fine particles of retained carbides are not available to serve as nuclei for the formation of the upper transformation products on cooling.

Figure 1:
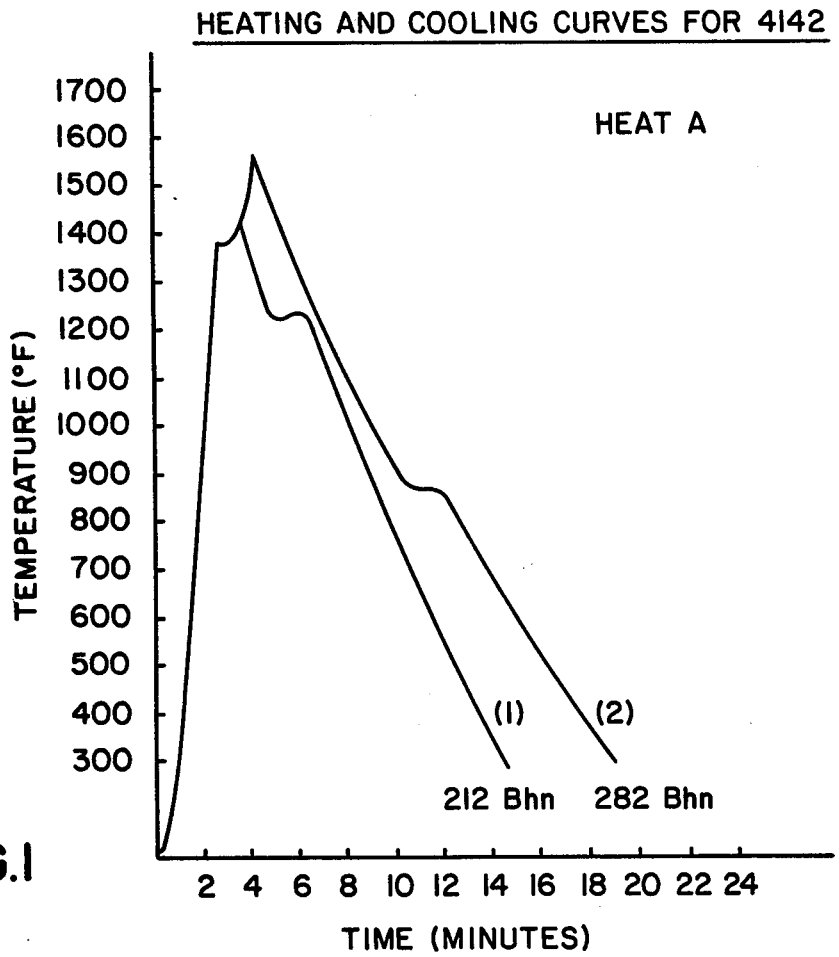
FIG. 1 is a graph of temperature versus time, representing the heating and cooling of two steel specimens to show the temperature dependence of accelerated annealing in accordance with the present invention.

In the practice of this invention, the steel workpiece is heated to a temperature above the $A_3$ or upper transformation temperature at a very rapid rate, usually within the range of one second to ten minutes. The control of the heating step may be effected within relatively narrow limits by making use of the well-known endothermic character of austenite transformation. As is now well established, the temperature of the workpiece at the onset of austenitic transformation remains constant, or even decreases slightly for a period ranging from a few seconds to several minutes, depending somewhat on the heating rate. A typical heating curve for the austenitizing step used in the practice of this invention is shown in FIG. 1 of the drawing, which is a plot of temperature versus time for heat A of 4142 steel. (The chemistry for that particular heat is shown in Table 1, supra.) As can be seen from that figure, two steel workpieces were rapidly heated in less than five minutes at austenitizing temperatures of 1412° F. for sample (1) and 1550° F. for sample (2). The heating curve indicates that carbide dissolution is taking place when the rate of temperature increase remains constant, that is at the so called heating arrest point. Care must be taken when that point is reached to insure that all of the carbides do not dissolve in the austenite thus formed. It is an important concept of this invention that sufficient quantities of carbide be retained in undissolved state to serve as nuclei for precipitation of the upper transformation products on cooling of the workpiece.

Thus, heating to the austenitization temperature is continued for a short time above the heating arrest point. During this time, austenitization of most of the structure is completed, and the structure which exists at the point of maximum temperature consists essentially of austenite and undissolved carbide particles. Following the austenitizing, the workpieces are allowed to air cool at their own rate.

As shown in FIG. 1, the steels exhibit a cooling arrest (1220° F. for sample (1) and 880° F. for sample (2)) at which point precipitation of transformation products begins. The cooling arrest point is thus determined by the austenitizing temperature employed. In the case of sample (1), the austenitizing temperature was such that the sample cooled to form upper transformation products, while sample (2), austenitized at the higher temperature, cooled to form lower transformation products.

The complete data on this phenomenon is shown in the following table:

TABLE 2

MECHANICAL PROPERTIES OF 4142 - AUSTENITIZED AND AIR COOLED SPECIMENS

| SPECIMEN | Hardness (Bhn) | Tensile (ksi) | Yield (ksi) | EL (%) | RA (%) |
|---|---|---|---|---|---|
| As Received Steel | 311 | 153.0 | 77.3 | 14.1 | 37.2 |
| Austenitized at 1412° F. (Time: 3 min.-36 sec.) | 212 | 110.4 | 63.9 | 24.0 | 59.7 |
| Austenitized at 1430° F. (Time: 3 min.-58 sec.) | 235 | 127.1 | 70.4 | 18.5 | 41.6 |
| Austenitized at 1480° F. (Time: 4 min.-26 sec.) | 266 | 135.2 | 74.3 | 17.9 | 40.2 |
| Austenitized at 1550° F. (Time: 5 min.-2 sec.) | 282 | 147.3 | 95.9 | 16.1 | 42.2 |

The data show that the hardness of the steel increased (accompanied by a decrease in ductility) as the austenitizing temperature increased.

The foregoing data demonstrate that accelerated annealing in accordance with the present invention is dependent on austenitization temperature. If the temperature is too high, all of the carbide dissolves, and hence no nuclei are available to accelerate the rate of precipitation of upper transformation products.

Figure 2:
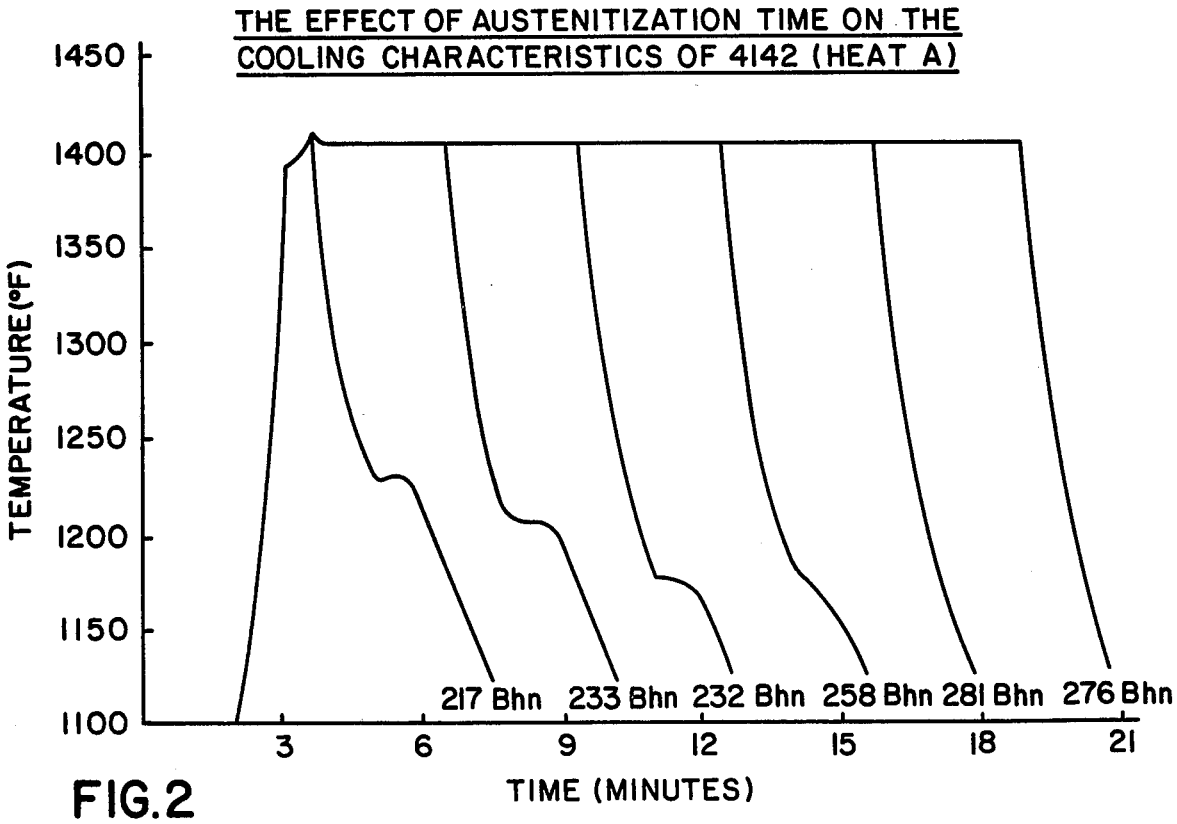
FIG. 2 is a graph of temperature versus time, representing the heating and cooling of several steel specimens to show the time dependence of accelerated annealing in accordance with the present invention.

It has also been found that time affects the annealing process of this inventon as well, with longer heatng times resulting in dissolution of all of the carbide particles present. This effect is shown in FIG. 2, which is another plot of temperature versus time for a series of samples held for varying lengths of time prior to air cooling. (The heating and cooling portions of this curve have been cut off at 1100° F. so that only the temperature where upper transformation products form are shown. The hardness values for each sample are also shown in the graph.)

As shown in FIG. 2, as the time at which the various samples are held at the austenitizing temperature is increased, the cooling arrest point decreases; as a result, there is a tendency for lower transformation products to form instead of the upper transformation products in accordance with the practice of this invention. Thus, the hardness values increase as the austenitizing time increased. Indeed, after 12 minutes at the austenitizing temperature, there is no cooling arrest within the temperature range shown in FIG. 2, and the hardest air-cooled specimens are produced.

The foregoing tests with 4142 specimens demonstrated that the accelerated annealing phenomenon of this invention is dependent upon both austenitizing temperature and austenitizing time. To demonstrate how the accelerated annealing phenomenon occurs, the microstructures of the steel prior to austenitization, at the austenitizing temperature, and after air cooling, were examined. The as received structure and the air cooled structure could be examined using standard metallographic techniques. To observe the condition of the austenite at the austenitizing temperature, a classical metallurgical quenching technique was used. A specimen from Heat A was rapidly heated to 1415° F. and quenched in agitated water. The parts of the structure that were austenite prior to the quench were converted to martensite. Consequently, the austenitized structure could be observed at room temperature with standard metallographic techniques by using an etchant that would not reveal the martensite.

Figure 3A:
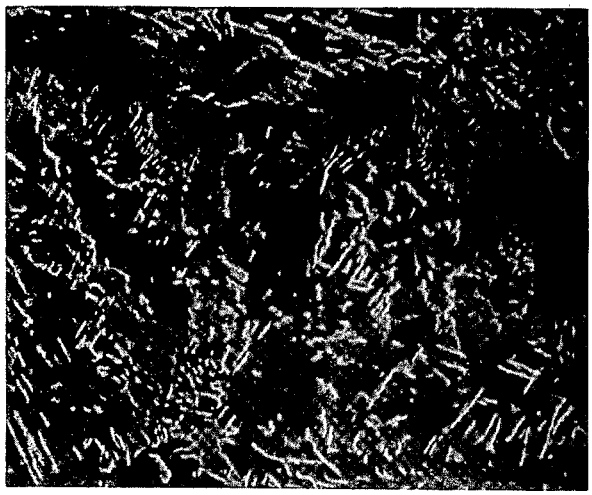
FIG. 3A is a photomicrograph showing the microstructure of 4142 steel prior to processing in accordance with the present invention (Heat A)
Figure 3B:
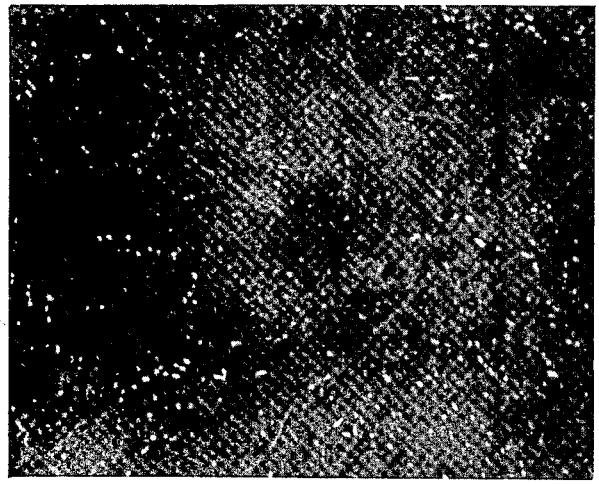
FIG. 3B is a photomicrograph showing the microstructure of 4142 steel after heating to 1415° F. followed by quenching (Heat A)
Figure 3C:
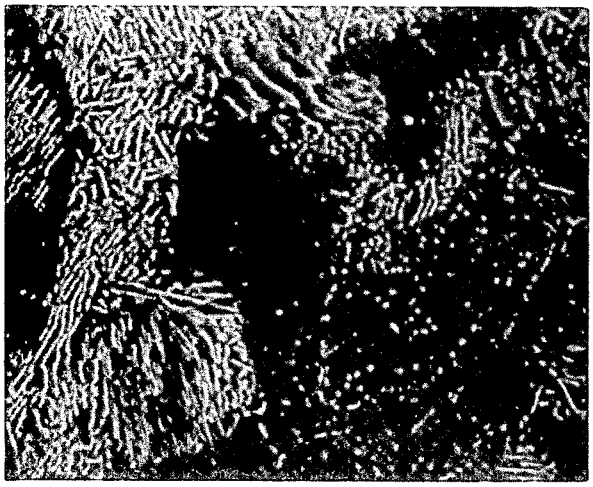
FIG. 3C is a photomicrograph showing the microstructure of 4142 steel after heating to 1415° F. and air cooling (Heat A)

FIGS. 3A, 3B and 3C show the as received structure, the austenitized-quenched structure, and the austenitizedair cooled structure of samples from Heat A. The scanning electron microscope (SEM) was used for these photomicrographs due to the fine nature of these structures.

This technique clearly revealed the structure of the steel before austenitizing, at the austenitizing temperature and after air cooling.

It can be clearly seen from these photomicrographs that the as received structure (before processing) was austenitized during the rapid heating cycle, but some particles of carbide remained undissolved in the austenite. Since nuclei already existed in the austenitized structure, there was no time required at the annealing temperature for nucleation of upper transformation products. The retained carbide particles simply began to grow as the temperature dropped below the $A_1$ temperature, and eventually pearlite began to grow from the carbide nuclei. Consequently, the time required to anneal the steel was shortened considerably. Several other grades of steel were tested in a similar manner, and, in each case, it was discovered that the austenitized structure consisted of austenite with fine spheroidal carbides. This retention of carbide in the austenitized structure due to rapid heating is believed to be the basis of the accelerated annealing phenomenon of this invention.

The retention of carbide in the austenitized structure of steel has been noted in the literature. However, with slower heating, the amount of carbide retained in the austenitized structure is small. Consequently, a steel which is slowly heated to the austenitizing temperature is less likely to display the accelerated annealing phenomenon. Comparison tests with furnace austenitizing treatments and rapid austenitizing treatments revealed that the accelerated annealing phenomenon did not occur with furnace treatments.

Figure 4:
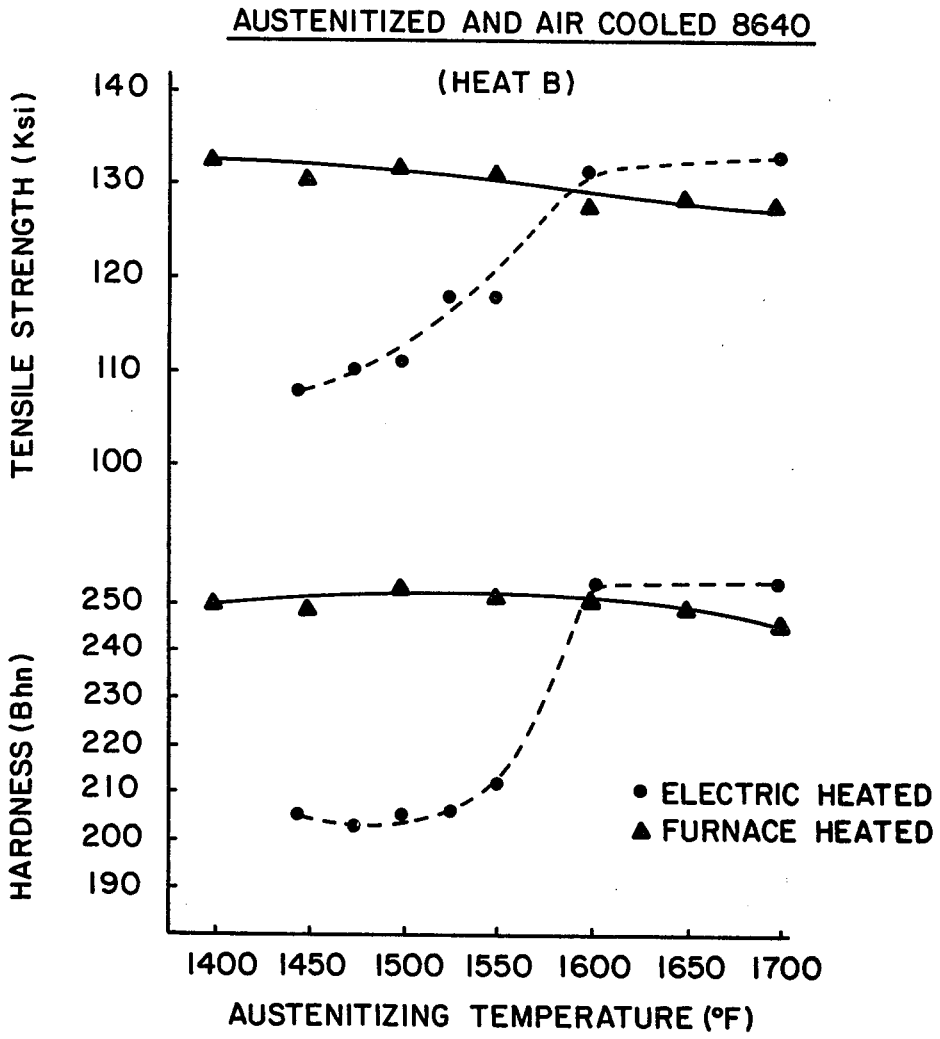
FIG. 4 is a graph of mechanical properties (hardness and tensile strength) versus austenitizing temperature of 8640 steel (Heat B)

In one of these tests, bars of 8640 from Heat B were austenitized at various temperatures in a furnace and allowed to air cool. Then another set of bars from the same heat was austenitized with electric resistance heating and allowed to air cool. The mechanical properties which resulted from this treatment are shown in FIG. 4. All of the furnace treated specimens cooled to a relatively high hardness. However, the rapidly heated specimens show a noticeable transition between hard and soft air cooled specimens. Table 3 shows the mechanical properties of one set of specimens from this test. The furnace austenitized specimen had mechanical properties very similar to those of the as received steel while the rapidly austenitized specimen was significantly softer. It is clear from that data that 8640 responded to the rapid austenitization in the same manner as the 4142 had responded. However, the accelerated annealing phenomenon is more apparent in 8640 because this steel has lower hardenability than 4142.

TABLE 3

MECHANICAL PROPERTIES OF 8640 - AUSTENITIZED AND AIR COOLED SPECIMENS

| SPECIMEN | Hardness (Bhn) | Tensile (ksi) | Yield (ksi) | EL (%) | RA (%) |
|---|---|---|---|---|---|
| As Received 8640 | 256 | 132.7 | 94.3 | 15.1 | 39.1 |
| Furnace Austenitized at 1500° F., Air Cooled (Time: 1 hr.) | 254 | 132:1 | 96.2 | 15.5 | 47.0 |
| Rapidly Austenitized at 1500° F., Air Cooled (Time: 4 min.) | 205 | 111.1 | 71.1 | 20.0 | 50.8 |

The tests demonstrate that the accelerated annealing phenomenon is sensitive to austenitizing temperature because the specimens which were rapidly austenitized above 1550° F. did not self-anneal. These tests also demonstrate that the accelerated annealing phenomenon is dependent upon austenitizing time as well because none of the furnace austenitized specimens annealed during air cooling regardless of the austenitizing temperature. Furnace treatments are simply too slow to permit the accelerated annealing phenomenon to occur. The relatively long time at the austenitizing temperature permits the retained carbide to be dissolved or reduced in size to the point where there is not enough carbide left to be effective as nuclei for carbide growth during cooling.

Figure 5:
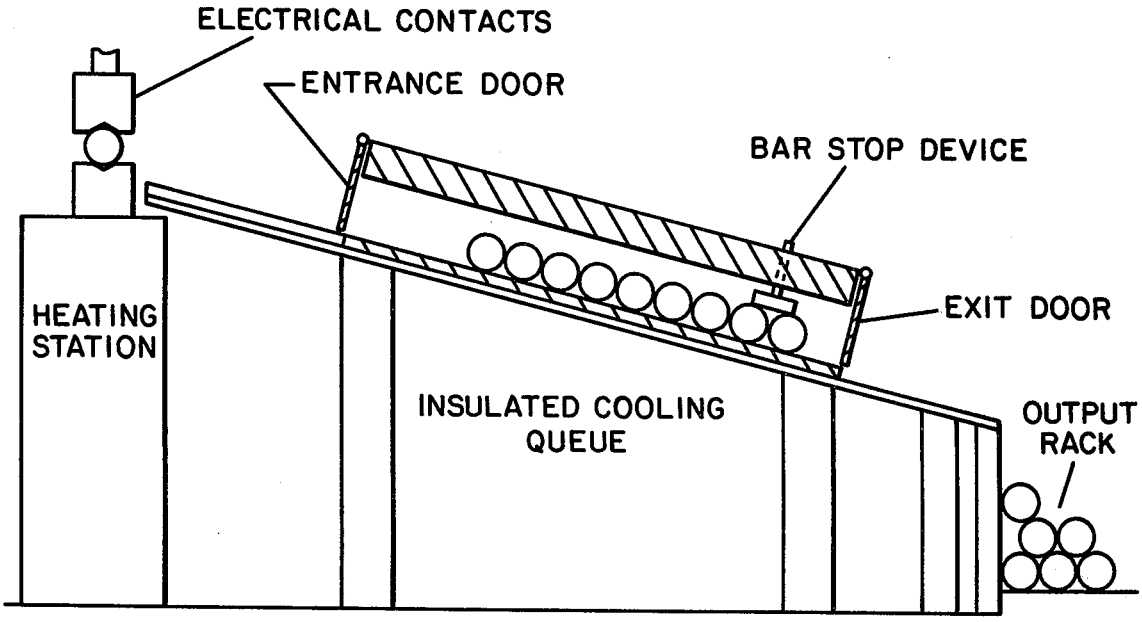
FIG. 5 is a schematic illustration of apparatus used for annealing in accordance with the concepts of this invention.

In accordance with one variation in the practice of this invention, it is sometimes desirable to insure uniformity in cooling rates in large batches of workpieces being processed. If, for example, steel bars were simply heated and piled in a rack to cool, the first bar might cool at a much faster rate than the last, and hence lack of uniformity within a batch of steel processed at one time might develop. Accordingly, to avoid lack of uniformity of batches, use can be made of an insulated cooling queue of the sort illustrated in FIG. 5 of the drawing. When using this type of equipment, it is possible to pass bars through the queue with a dwell or residence time of, for example, 10 minutes. No external source of heat need be used in equipment of that type, and hence no energy is consumed. Tests with respect to uniformity of mechanical properties have demonstrated that the insulated cooling queue is effective.

Having described the basic concepts of the present invention, reference is now made to the following examples, which are provided by way of illustration and not by way of limitation, of the practice of the present invention in the annealing of steel bars having a length of 7 feet. In each example, the steel was examined in three conditions, namely as received or prior to any treatment, after furnace annealing, and after annealing by the process of this invention, with comparisons having been made between the furnace annealed steel and steel annealed by way of this invention.

EXAMPLE 1

This example illustrates the annealing of a 4140 steel from heat C as shown in Table 1.

Twenty bars of 4140 from Heat C were furnace annealed using a roller hearth furnace. The furnace austenitizing temperature was 1550° F., and the annealing cycle was a total of 16 hours long.

Twenty bars from the same heat were also annealed by the process of this invention. The austenitizing temperature was 1450° F. and each bar was austenitized in 33 seconds. The total annealing time for all 20 bars was less than one hour.

Both lots of steel were cleaned, cold drawn and straightened after annealing. Then the two lots were extensively tested, and the steel that remained after testing was used for a machinability test. Table 4 shows the mechanical properties of the steel used in these tests. The mechanical properties of the as received steel and the as annealed steel are shown for comparison purposes.

The steel annealed by the process of this invention has a better combination of properties than the furnace annealed steel. The hardness of the steel annealed by the present process is slightly higher, but the significant difference between the two products is the improved ductility of the steel annealed by the process of the invention. The elongation was 13.3% for the furnace annealed steel after complete processing, and the elongation for the steel annealed by this process was 17.0%. This is an improvement of 28%. The reduction of area for the furnace annealed steel was 39.0% and the reduction of area for the steel annealed by the present process was 59.3%. This is an improvement of 52%. The elongation and reduction of area are a basis for estimating the ductility of a steel, and these improvements over the furnace annealed steel indicate a drramatic improvement in ductility and formability.

TABLE 4

MECHANICAL PROPERTIES OF 4140 - HEAT C

| SPECIMEN | Hardness (Bhn) | Tensile (ksi) | Yield (ksi) | EL (%) | RA (%) |
|---|---|---|---|---|---|
| As Received 4140 | 315 | 151.0 | 120.5 | 13.0 | 39.4 |
| Furnace Annealed | 197 | 99.7 | 46.6 | 21.5 | 40.8 |
| Annealed by the Present Process | 217 | 108.0 | 58.7 | 23.5 | 60.9 |
| Furnace Annealed & Cold Drawn | 226 | 111.5 | 81.2 | 13.3 | 39.0 |
| Annealed by the Present Process & Cold Drawn | 238 | 119.4 | 93.9 | 17.0 | 59.3 |

Figure 6A:
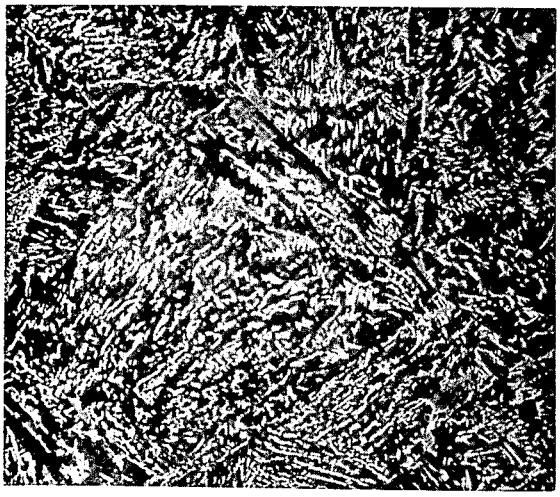
FIG. 6A is a photomicrograph showing the microstructure of 4140 steel prior to treatment in accordance with the present invention (Heat C)
Figure 6B:
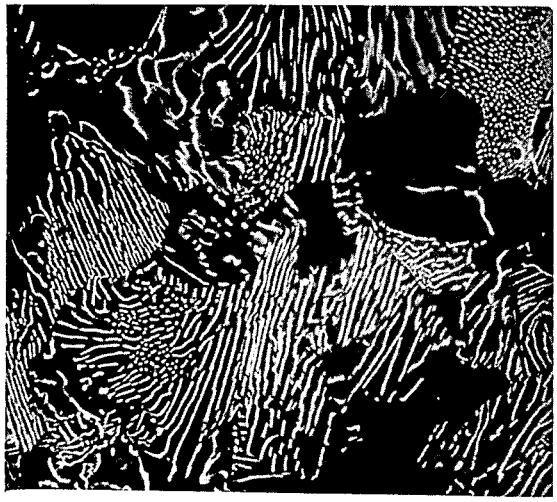
FIG. 6B is a photomicrograph showing the microstructure of 4140 steel after furnace annealing (Heat C)
Figure 6C:
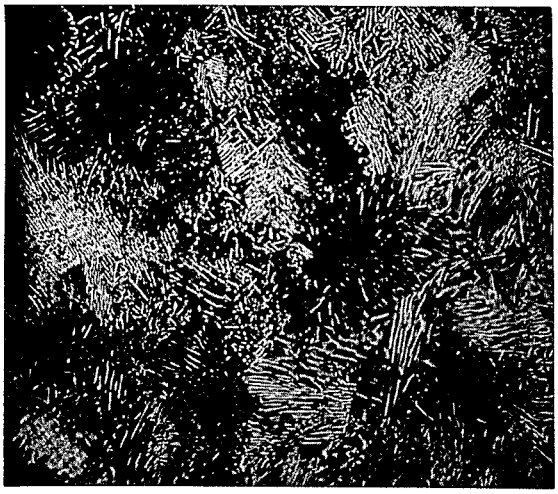
FIG. 6C is a photomicrograph showing the microstructure of 4140 steel which has been annealed in accordance with the process of this invention (Heat C)

The reason for the improved ductility of the product annealed by the present process can be clearly seen in the microstructure of these steel samples. FIGS. 6A, 6B, and 6C show the microstructures of samples from this heat of 4140 in three conditions: as received, furnace annealed, and annealed by the process. The as received structure consists of lower transformation products: upper bainite and acicular ferrite. The furnace annealed structure consists of pearlite and ferrite. The steel annealed by the present process has a structure which consists essentially of ferrite, pearlite and fine carbide spheroids. Ferrite areas are not distinct, and the ferrite contains spheroidal carbides. Also, the grain size is finer for the steel annealed by the present process. It is the fine nature of this structure which gives the steel its improved ductility and formability over the coarse furnace annealed structure.

Figure 7:
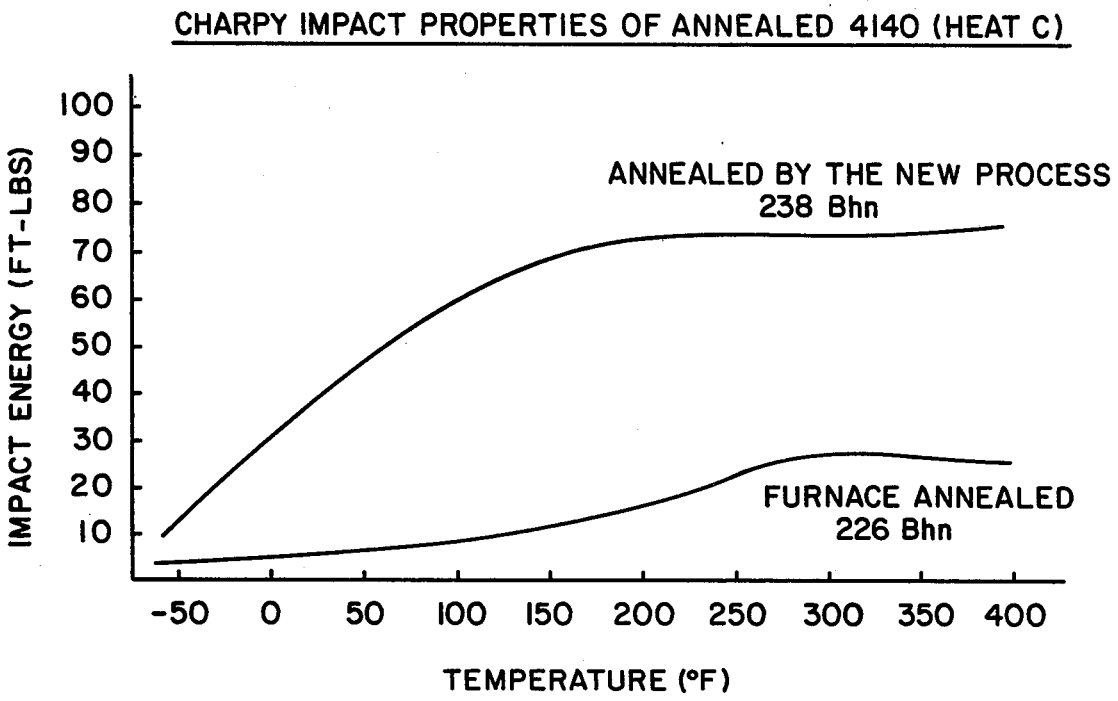
FIG. 7 is a graph of Charpy impact energy versus temperature for 4140 steel which has been furnace annealed and annealed by the process of this invention (Heat C)

The fine microstructure also gives the annealed product improved toughness. FIG. 7 shows the Charpy impact curves for bars taken from the two lots of annealed steel. The steel annealed by the present process has a lower transition temperature, and an upper shelf energy which is almost three times that of the furnace annealed steel. Improved toughness is valuable for applications where the part is machined or formed, and then only surface hardened. In such applications, improved core toughness would give the part higher resistance to fracture.

Figure 8:
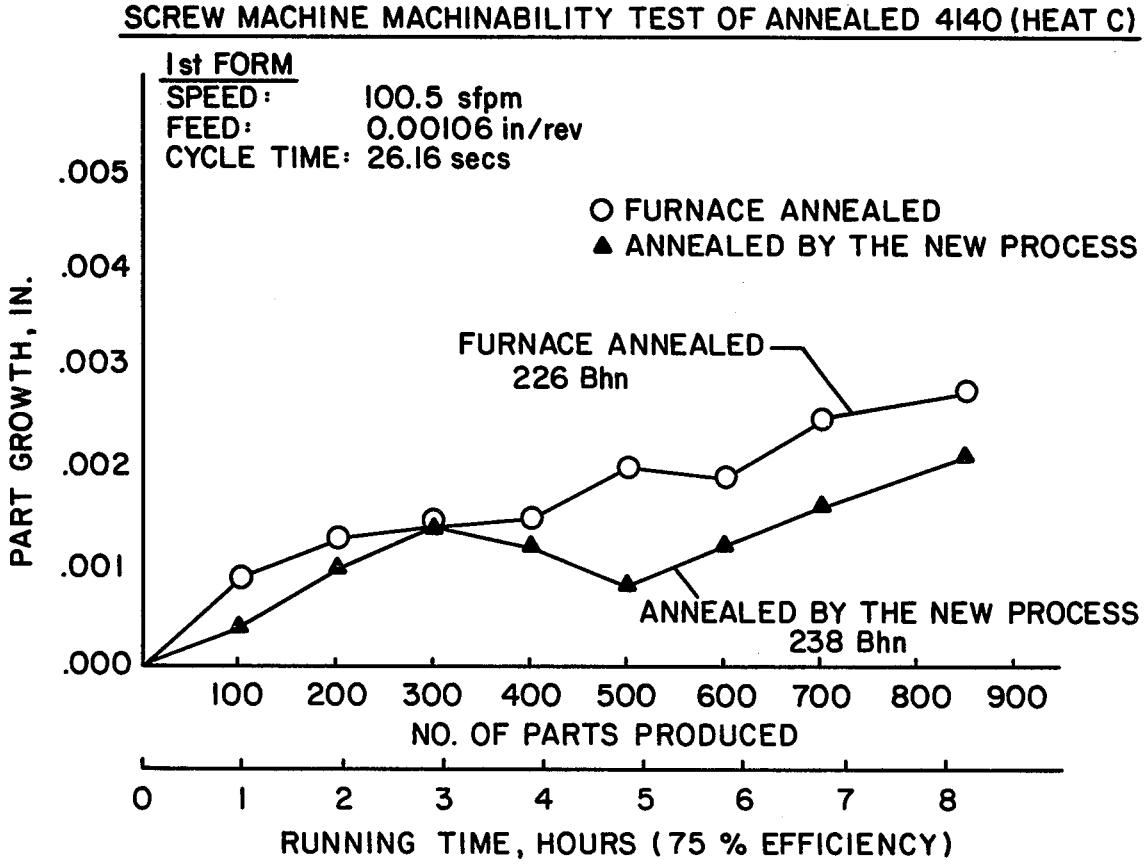
FIG. 8 illustrates the results of machinability testing (in the form of a plot of part growth versus parts produced in running time) for 4140 steels which have been furnace annealed and annealed in the process of this invention (Heat C)

To demonstrate that the improved toughness and ductility of steel annealed by the instant process did not adversely affect its machinability as compared to that of furnace annealed steel, a comprehensive machinability test was carried out. The screw machine test was selected because it tests the machinability of the steel with several different types of tools. FIG. 8 shows the results of machinability testing of the two annealed lots of 4140 from Heat C. In this type of test, part growth is measured and plotted against time or the number of parts produced. Steels which machine well have part growth curves which are relatively flat and near the time axis. Steels which machine poorly have curves which have steep slopes. The part growth curves shown in FIG. 8 indicate that the two annealed steels machined about the same. The steel annealed by the present process was slightly better than the furnace annealed steel, but the difference is not considered significant.

EXAMPLE 2

This example illustrates the annealing at a 4140 steel from heat D.

Twenty bars from Heat D were furnace annealed using a 16 hour cycle with an austenitization temperature of 1550° F. Then 20 additional bars from the same heat were annealed by the present process. For this treatment each bar was austenitized at 1500° F. in approximately 36 seconds, and the entire lot was annealed in less than one hour.

Figure 9A:
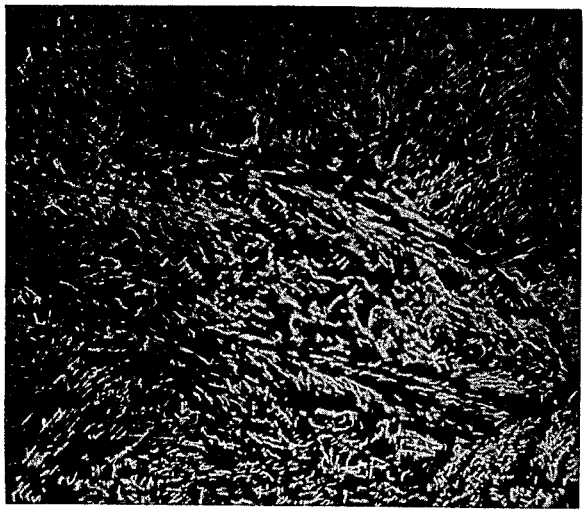
FIG. 9A is a photomicrograph showing the microstructure of 4140 steel prior to processing in accordance with the present invention (Heat D)
Figure 9B:
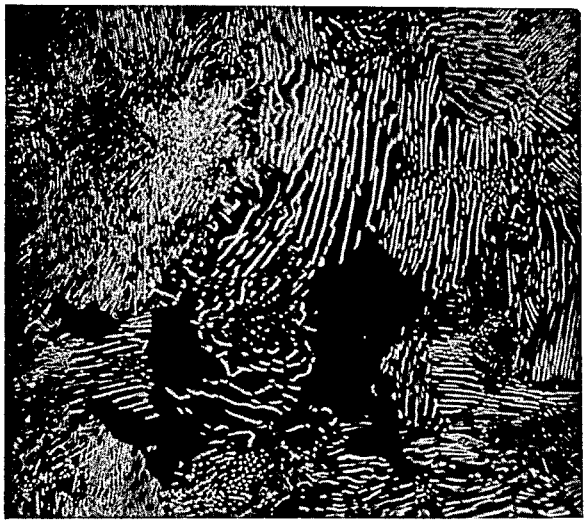
FIG. 9B is a photomicrograph showing the microstructure of 4140 steel after furnace annealing (Heat D)
Figure 9C:
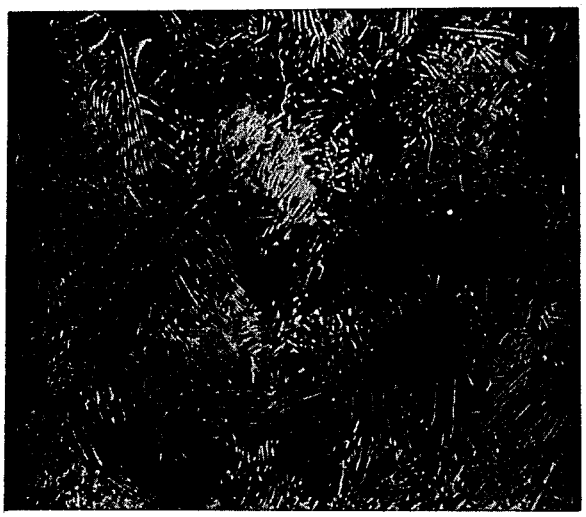
FIG. 9C is a photomicrograph of 4140 steel as annealed by the process of this invention (Heat D)

Both lots were then descaled, cold drawn and straightened. Extensive testing was conducted on each lot, and the steel that remained after this testing was used for a machinability test. The mechanical properties of the as received steel, the furnace annealed steel and the steel annealed by the new process are shown in Table 5. Once again, the steel annealed by the present process had greater ductility and was slightly harder than the furnace annealed steel. FIGS. 9A, 9B and 9C show the microstructure of this heat of steel in three conditions: as received, furnace annealed, and annealed by the present invention, respectively. Just as before, the steel annealed by the present process has a microstructure which is much finer than the furnace annealed steel.

TABLE 5

MECHANICAL PROPERTIES OF 4140 - HEAT D

| SPECIMEN | Hardness (BHN) | Tensile (ksi) | Yield (ksi) | EL (%) | RA (%) |
|---|---|---|---|---|---|
| As Received 4140 | 311 | 151.4 | 109.6 | 13.3 | 41.9 |
| Furnace Annealed and Cold Drawn | 231 | 119.1 | 102.3 | 12.1 | 42.8 |
| Annealed by the Present Process and Cold Drawn | 241 | 127.4 | 105.9 | 13.8 | 53.1 |

Figure 10:
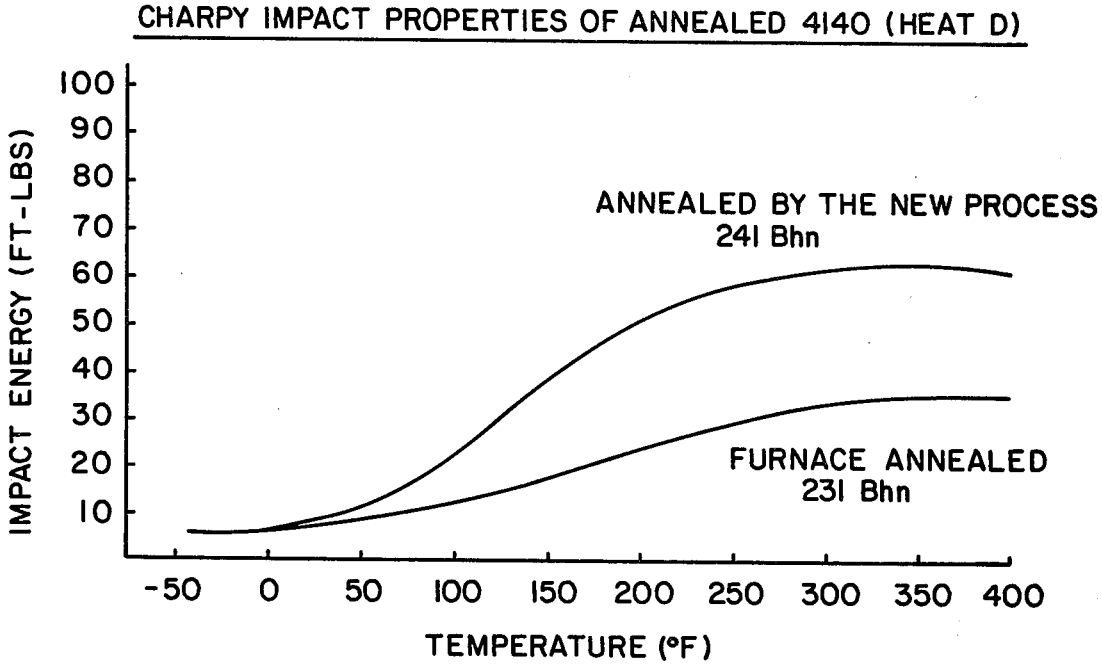
FIG. 10 is a plot of Charpy impact energy versus temperature for 4140 steel which has been furnace annealed and annealed by the process of this invention (Heat D)

FIG. 10 shows the Charpy impact curves for the furnace annealed steel and the steel annealed by the present process. The superiority of the steel annealed by the present process is again obvious. The transition temperature is lower and the upper shelf energy is higher for the steel annealed by the present process.

Figure 11:
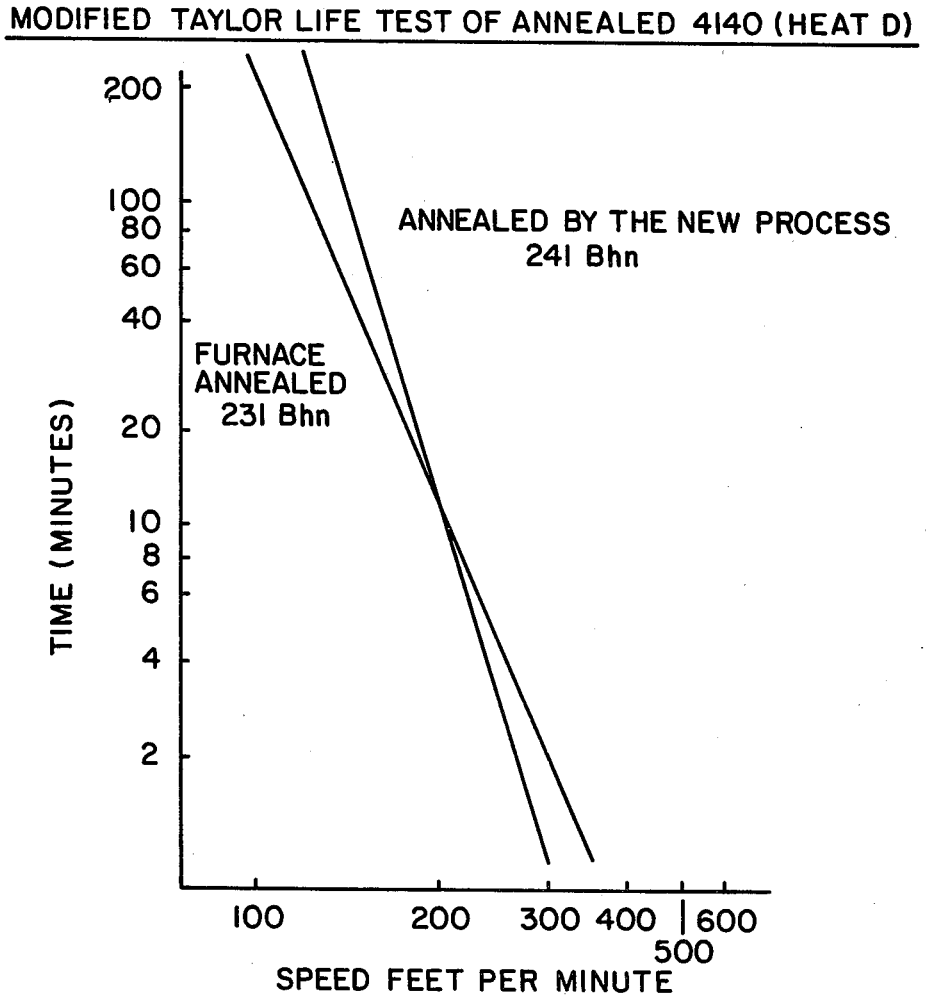
FIG. 11 is a graph (in the form of time versus speed as determined by a modified Taylor life test) of 4140 steel which has been furnace annealed and annealed by the process of this invention (Heat D)

Machinability testing of the two annealed lots of steel was accomplished using a Modified Taylor Life test. In this type of machinability test, the bar is turned at various speeds and feeds until the machining tool fails. Then the data points representing the time to failure at various speeds are plotted on log-log paper. The result is a straight line which represents the relationship between machining speed and time to tool failure. FIG. 11 shows the results of this type of machinability testing on the two annealed lots produced from Heat D. The two lines cross, indicating that there is some difference between the way these two annealed steels machined. However, at the lower machining speeds, where alloy steels are usually machined, the steel annealed by the present process is slightly better. Once again, even though the steel annealed by the present process was harder, tougher, and more ductile, it machined better than the furnace annealed steel. These differences in ductility, toughness and machinability are in the aggregate, a significant improvement in the mechanical properties of this steel.

EXAMPLE 3

Ten bars of 4140 steel from Heat E were furnace annealed using a 16 hour cycle with an austenitization temperature of 1550° F. Then ten bars from the same heat were annealed by the present process using an austenitization temperature of 1450° F. The bars were each austenitized in 35 seconds, and the entire annealing cycle was 45 minutes long. Table 6 shows the results of this processing. The specimens made in this test were not cold drawn after annealing. This heat responded to annealing by the present process almost exactly as the other heats had responded. The superior ductility of the steel annealed by the process of this invention is apparent from the data in Table 6.

TABLE 6

MECHANICAL PROPERTIES OF 4140 - HEAT E

| SPECIMEN | Hardness (Bhn) | Tensile (ksi) | Yield (ksi) | EL (%) | RA (%) |
|---|---|---|---|---|---|
| As Received 4140 | 269 | 141.6 | 99.2 | 15.7 | 50.2 |
| Furnace Annealed Steel | 186 | 103.7 | 49.6 | 19.7 | 42.6 |
| Annealed by the process of this invention | 194 | 104.5 | 97.1 | 24.6 | 60.5 |

EXAMPLE 4

15 bars of 4142 from Heat F were annealed using a furnace. The austenitizing temperature for the furnace treatment was 1550° F. and the cycle was 16 hours long. Then 15 more bars from the same heat were annealed by the process of this invention. An austenitizing temperature of 1450° F. was used, and each bar was austenitized in 60 seconds. The entire cycle was less than one hour long. Table 7 shows the mechanical properties of the steel in three conditions: as received, furnace annealed, and annealed by the process of this invention. Once again, the steel annealed by the present process had superior ductility as compared to that of the furnace annealed steel.

TABLE 7

MECHANICAL PROPERTIES OF 4142 - HEAT F

| SPECIMEN | Hardness (Bhn) | Tensile (ksi) | Yield (ksi) | EL (%) | RA (%) |
|---|---|---|---|---|---|
| As received 4142 | 268 | 141.0 | 99.1 | 15.5 | 46.5 |
| Furnace Annealed Steel | 194 | 101.8 | 50.3 | 20.8 | 46.6 |
| Annealed by the present process | 196 | 102.3 | 66.2 | 25.0 | 68.3 |

EXAMPLE 5

Ten bars of 8640 from Heat B were annealed using the roller hearth furnace. The furnace austenitizing tmeperature was 1550° F. and the furnace cycle was a total of 16 hours. Then ten bars from the same heat were annealed using the present process. The austenitizing temperature was 1450° F., and each bar was austenitized in 35 seconds. The total annealing cycle with the process of this invention was approximately 30 minutes. Table 8 shows the mechanical properties of the steel in three conditions: as received, furnace annealed and annealed by the instant process. Once again, the steel annealed by the process of this invention had significantly better ductility than the furnace annealed steel.

TABLE 8

MECHANICAL PROPERTIES OF 8640 - HEAT B

| SPECIMEN | Hardness (Bhn) | Tensile (ksi) | Yield (ksi) | EL (%) | RA (%) |
|---|---|---|---|---|---|
| As Received 8640 | 258 | 132.1 | 102.8 | 16.7 | 46.9 |
| Furnace Annealed Steel | 176 | 98.9 | 49.3 | 22.8 | 47.0 |
| Annealed by the present process | 180 | 98.9 | 60.4 | 28.1 | 64.6 |

The microstructures of the as received steel, the furnace annealed steel, and the steel annealed by the process of this invention are shown in FIGS. 12A, 12B and 12C. The steel annealed by the present process had a more spheroidal structure than the furnace annealed steel, and it was somewhat finer. This difference in microstructure is similar to what was observed in the 4140 tests. The 8640 was also tested for toughness using the Charpy impact test. The results of impact testing of the two annealed lots is shown in FIG. 13. Once again the steel annealed by the present process had far superior toughness. (It should be noted that the annealed 8640 was not cold drawn prior to testing. Consequently, it was somewhat softer and tougher than the 4140 heats that were mentioned earlier.)

EXAMPLER 6

Twenty bars of 6150 from Heat G were annealed using a roller hearth furnace. The furnace austenitizing temperature was 1550° F. and the cycle was 16 hours.

Then twenty bars from the same heat were annealed with the process of this invention using an austenitizing temperature of 1500° F. Each bar was austenitized in 34 seconds, and the total annealing time was approximately one hour. Table 9 shows the mechanical properties of the as received steel, furnace annealed steel, and steel annealed by the present process.

The two annealed lots were then cold drawn and straightened to duplicate one type of typical commercial processing. The cold drawn and straightened properties are also given in Table 9. For this particular grade, the steel treated with the present process was slightly harder than the furnace annealed steel, but it was still more ductile. This superior ductility is evident both before and after cold drawing.

TABLE 9

MECHANICAL PROPERTIES OF 6150 - HEAT G

| SPECIMEN | Hardness (Bhn) | Tensile (ksi) | Yield (ksi) | EL (%) | RA (%) |
|---|---|---|---|---|---|
| As Received 6150 | 299 | 151.0 | 111.6 | 12.0 | 37.8 |
| Furnace Annealed Steel | 195 | 100.8 | 53.0 | 20.7 | 44.1 |
| Annealed by the present process | 225 | 109.8 | 81.2 | 25.5 | 66.4 |
| Furnace annealed cold drawn straightened | 240 | 120.4 | 86.0 | 9.6 | 31.3 |
| Annealed by the present process cold drawn | 263 | 130.9 | 103.8 | 13.0 | 48.3 |

TABLE 9-continued

| MECHANICAL PROPERTIES OF 6150 - HEAT G | | | | | |
|---|---|---|---|---|---|
| SPECIMEN | Hardness (Bhn) | Tensile (ksi) | Yield (ksi) | EL (%) | RA (%) |
| straightened | | | | | |

The microstructure of the as received steel, the furnace annealed steel, and the steel annealed by the present process are shown in FIGS. 14A, 14B and 14C, respectively. The steel annealed by the present process has a finer carbide structure than the furnace annealed steel. Charpy impact testing was also accomplished on the two annealed samples and the results are shown in FIG. 15. The curves shown are for the 6150 after cold drawing. Once again the steel annealed by the present process had a finer microstructure, improved ductility and improved toughness as compared to the furnace annealed steel.

EXAMPLE 7

Several bars of 1144 from Heat H were furnace annealed using a five hour cycle. The austenitization temperature was 1550° F. for the furnace treatment.

Then five bars from the same heat were annealed using the present process. The austenitization temperature was 1450° F. and the annealing time for the five bars was 20 minutes. Each bar was austenitized in 30 seconds.

Table 10 shows the mechanical properties of the as received steel, the furnace annealed steel and the steel annealed by the process of the invention. In this case, the hardness of the steel annealed by the present process was very near that of the furnace annealed steel. As with the previous examples, the steel annealed by the present process has superior ductility. FIGS. 16A, 16B and 16C show the microstructure of this steel in three conditions: as received, furnace annealed, and annealed by the present process, respectively.

TABLE 10

| MECHANICAL PROPERTIES OF 1144 - HEAT H | | | | | |
|---|---|---|---|---|---|
| SAMPLE | Hardness (Bhn) | Tensile (ksi) | Yield (ksi) | EL (%) | RA (%) |
| As Received Steel Hot Rolled 1144 | 190 | 99.0 | 60.9 | 19.5 | 41.4 |
| Furnace Annealed | 162 | 89.5 | 51.3 | 23.1 | 41.1 |
| Annealed by the present process | 165 | 89.1 | 57.4 | 25.0 | 48.5 |

EXAMPLE 8

Several bars of 86L20 from Heat I were furnace annealed using a five hour cycle. The austenitizing temperature used for the furnace anneal was 1625° F.

Then 15 bars from the same heat were annealed using the present annealing process. The austenitizing temperature used was 1600° F., and each bar was austenitized in 31 seconds. The total annealing cycle was 47 minutes.

Table 11 shows the mechanical properties of the as received steel, the furnace annealed steel, and the steel annealed by the present process. For this grade of steel, the improvement in ductility for the steel annealed by the present process is relatively small. Also, the hardness of the steel annealed by the present process was rather high. The reason for these differences is clear from the photomicrographs of the structures of this heat of steel (FIGS. 17A, 17B and 17C). The grain size of the steel annealed by the present process is much finer than the grain size of the furnace annealed steel. In a low carbon steel like 86L20, the fine grain size which results from the new annealing process is the dominant factor. There is not enough carbon in the steel for the carbides to play a dominant role, and the grain size effect makes the steel annealed by the pesent process somewhat harder than the furnace annealed product. Consequently, only marginal improvements in ductility were achieved with the present annealing process.

TABLE 11

| MECHANICAL PROPERTIES OF 86L20 - HEAT I | | | | | |
|---|---|---|---|---|---|
| SAMPLE | Hardness (Bhn) | Tensile (ksi) | Yield (ksi) | EL (%) | RA (%) |
| As Received 86L20 | 172 | 83.2 | 53.3 | 25.2 | 62.4 |
| Furnace Annealed | 141 | 74.9 | 49.5 | 29.7 | 62.1 |
| Annealed by the present process | 160 | 81.9 | 60.1 | 30.0 | 65.2 |

The foregoing examples demonstrate that the present annealing process is applicable to a wide variety of carbon and alloy steels. Each grade that was tested responded to the present annealing process in about the same way. For each alloy, a finer carbide morphology was produced which gave the steel improved ductility, formability and toughness. It is important to note that these improved properties were achieved with no loss of strength or loss of machinability. This combination of improved ductility, formability and toughness with no loss of machinability is an unexpected phenomenon. Usually when ductility and toughness increase at a given hardness level, the machinability decreases. However, the new annealing process creates a structure which does not follow this general trend.

It will be apparent from the foregoing that the present invention provides a significant improvement in the annealing of hypoeutectoid steel. It affords improved energy efficiency through the use of direct electrical resistance heating, and, at the same time, eliminates the need for long controlled cooling cycles of the sort that have been required in the furnace annealing of steels. In addition, the process of this invention eliminates the need for protective or non-oxidizing atmospheres of the sort required with furnace annealing procedures heretofore used by the prior art.

It will be apparent that various changes and modifications can be made in the procedures of carrying out the present invention as well as the equipment employed without departing from the spirit of the invention, especially as defined in the following claims.

I claim:

1. A method for annealing a hypoeutectoid steel which results in improved ductility, formability, and toughness comprising:

(a) providing a hypoeutectoid steel workpiece, (b) rapidly heating said workpiece to a temperature above the upper transformation temperature for said steel, maintaining said workpiece at said temperature for a sufficient period of time to cause transformation of ferrite to austenite and the dissolution of substantially all of the carbides but less than that period of time which would cause complete dissolution of said carbides thereby leaving a minor amount of undissolved particulate carbides in said steel sufficient to serve as nuclei for the precipitation of upper transformation products upon cooling, (c) cooling said workpiece, and (d) controlling said method to cause a cooling arrest above 1100° F. and precipitation of said upper transformation products.

2. A process as defined in claim 1 wherein the hypoeutectoid steel contains up to 0.7% carbon by weight.

3. A process as defined in claim 1 wherein the steel contains between 0.1 to 0.7% carbon by weight.

4. A process as defined in claim 1 wherein the steel contains less than 5% by weight of an alloying element.

5. A process as defined in claim 4 wherein the alloying element is selected from the group consisting of chromium, molybdenum, nickel, manganese and combinations thereof.

6. A process as defined in claim 1 wherein the steel is heated to above upper transformation temperature in less than ten minutes.

7. A process as defined in claim 1 wherein the steel is heated by direct electrical resistance heating.

8. A process as defined in claim 1 wherein the steel is in the form of a workpiece having a repeating cross section.

9. A process as defined in claim 1 wherein the heating of the steel takes place in the absence of an inert atmosphere.

10. A process as defined in claim 1 wherein the annealed steel contains pearlite, ferrite and spheroidal carbides.

* * * * *

UNITED STATES PATENT AND TRADEMARK OFFICE

CERTIFICATE OF CORRECTION

PATENT NO. : 4,457,789

DATED : July 3, 1984

INVENTOR(S) : Gerald W. Wilks

It is certified that error appears in the above-identified patent and that said Letters Patent is hereby corrected as shown below:

Column 2, line 16, after "of" insert --heating--

Column 2, line 16, after "versus" insert --heating--

Column 2, lines 21-23, after "steel" insert --bars-- and delete --specimens to show the time dependence of accelerated annealing--

Column 5, line 37, after "minutes" change "at" to --to--

Column 6, line 29, "inventon" should read --invention--

Column 6, line 29, "heatng" should read --heating--

Column 7, lines 2 & 3, "austenitizedair" should read --austenitized-air--

Column 9, line 20, "drramatic" should read --dramatic--

Column 12, line 35, "EXAMPLER 6" should read --EXAMPLE 6--

Signed and Sealed this

*Twenty-first* Day of *May 1985*

[SEAL]

*Attest:*

DONALD J. QUIGG

*Attesting Officer* *Acting Commissioner of Patents and Trademarks*